US005908362A

United States Patent [19]

Carr

[11] Patent Number: 5,908,362

[45] Date of Patent: Jun. 1, 1999

[54] TENSIONING DEVICE FOR STRINGING SPORTS RACQUETS HAVING A STRING GUIDE FOR MAINTAINING CONSTANT STRING LINE OF ACTION TO STRING GRIPPER

[75] Inventor: Ronald H. Carr, Plum Boro, Pa.

[73] Assignee: Ferrari Importing Company, Pittsburgh, Pa.

[21] Appl. No.: 09/022,144

[22] Filed: Feb. 11, 1998

Related U.S. Application Data

[60] Provisional application No. 60/040,399, Feb. 11, 1997.

[51] Int. Cl.[6] ..... A63B 51/14

[52] U.S. Cl. ..... 473/557

[58] Field of Search ..... 473/555, 556, 473/557, FOR 175, FOR 176

[56] References Cited

U.S. PATENT DOCUMENTS

| | | | |
|---|---|---|---|
| 2,309,849 | 2/1943 | Kausal et al. | 473/556 |
| 3,511,502 | 5/1970 | Spenle | 473/556 |
| 4,348,024 | 9/1982 | Balaban | 473/556 |
| 5,026,055 | 6/1991 | Longeat | 473/556 |
| 5,080,360 | 1/1992 | Longeate | 473/556 |

*Primary Examiner*—Raleigh W. Chiu
*Attorney, Agent, or Firm*—Michael R. Swartz; John R. Flanagan

[57] ABSTRACT

A racquet stringing machine includes a base, a racquet mounting frame attached to the base for mounting and securing a racquet to be strung with string, a string clamping device which holds the clamped end of the string in place relative to the racquet frame while tension is being applied to the tensioning end of the string and a string tensioner having a string tensioner frame mounted to the base in offset relation to the racquet mounting frame, a tension setting mechanism movably mounted to the string tensioner frame for applying a desired amount of tension to the strings and a string gripper mounted to the tension setting mechanism for holding the tensioning end of the string while tension is applied. The racquet stringing machine is improved by providing a rotational string guide mounted in a fixed relation to the string gripper which guides the tensioning end of the string into the string gripper such that the line of action of the force from the string being tensioned against the string gripper remains the same regardless of the elevation of the clamped end of the string relative to the string gripper. In addition, the tension in the string on the string tensioner side of the string guide is the same as the string tension in the string on the string clamp side of the string guide.

20 Claims, 7 Drawing Sheets

TENSIONING DEVICE FOR STRINGING SPORTS RACQUETS HAVING A STRING GUIDE FOR MAINTAINING CONSTANT STRING LINE OF ACTION TO STRING GRIPPER

This application claims the benefit of U.S. provisional application No. 60/040,399, filed Feb. 11, 1997.

BACKGROUND OF THE INVENTION

1. Field of Invention

The present invention generally relates to machines or devices for stringing sports racquets and more particularly is concerned with a tensioning device for stringing sports racquets having a rotatable string guide for maintaining a constant string line of action to a string gripper of the tensioning device.

2. Description of Prior Art

There have been various types of devices and machines for stringing sports racquets which utilize a manual or electrical means to apply tension to the racquet strings by pulling and stretching the string. Some of these devices include an automatic means for stopping or braking the pulling action when the desired string tension is achieved by using a predetermined tension setting device, such as those disclosed in U.S. Pat. No. 3,441,275 to Held, U.S. Pat. No. 3,918,713 to Kaminstien and U.S. Pat. No. 5,026,055 to Longeat. Other devices use a visual scale which indicates when the desired tension is achieved, and the stopping or braking action is applied manually such as that disclosed in the U.S. Pat. No. 3,823,609 to Miyagawa.

In the disclosures of the Held and Kaminstien patents, the string tensioner relies on a counter force system where the string force from tensioning the string is applied via a string gripper device to a tension setting mechanism, comprised of a lever arm pivotally mounted to a frame. The lever arm is counter balanced on the end opposite to the string gripper by a counter force, such as that generated by compressing a spring. As the string tension increases, the leverage to the string tension side of the lever arm increases and causes the lever to rotate. After rotating a predetermined amount, based on the tension setting of the string tensioner, a braking device is activated that causes the string tensioner to stop pulling the string. In the event the angle in which the string enters the string gripper device of the string tensioner described in the above referenced prior art is altered due to a different elevation between the clamped end of the string and the tensioning end of the string, the leverage produced by the string tension against the lever arm, of the string tensioning mechanism, which opposes the leverage applied by the compression spring on the opposite end of the lever arm, will be different. Since the predetermined tension setting, which establishes when to activate the braking device is based on a fixed correlation between the leverage produced by the string tension and the leverage produced by the counter balance spring, a difference in the leverage produced by the string tension will cause the braking device to activate prematurely, resulting in less than desired tension in the strings, or will cause the braking device to activate late, causing more than the desired tension in the strings.

In other devices known to exist in the art, such as that disclosed by the Miyagawa patent, the string tensioner involves a string gripper mounted on one side of a tension setting mechanism, comprised of a connecting arm which is mounted to a frame via a shaft and bushing arrangement or a slide and block arrangement, that will only permit linear translation of the connecting arm. As the string is pulled and tensioned, a force sensing device, attached to the pulling side of the connecting arm between the connecting arm and pulling mechanism, senses the force applied to the connecting arm and converts this force into a tension reading. When the force applied to the connecting arm reaches an amount that corresponds to the desired amount of tension in the strings by way of a predetermined tension setting based on a fixed correlation between the measured force on the connecting arm and the tension in the string, a braking device is activated causing the tensioning mechanism to stop pulling the string. Once again, if the line of action of the string tension on the string gripper is at different angles relative to the connecting arm, the correlation between the string tension in the racquet and the force measured by the sensing device will be different causing the string tensioner to stop pulling the string either prematurely or later which will result in less or more tension in the strings than desired.

In all the above cited cases, the angle in which the string enters the string gripper of the string tensioner effects the line of action of the string force on the tension setting mechanism, and will influence correlation between the predetermined tension setting of the string tensioner which achieves the desired tension in the string, and the counter balance force system of the tension setting mechanism, or the correlation between the predetermined tension setting of the string tensioner which achieves the desired tension in the strings and the force sensing system. The counter balance force system and the force sensing system both have a fixed correlation to the tension settings of the string tensioner which sets a reference point as to when to stop tensioning the string in order to achieve the desired tension in the string. In the cases where the string might enter the string gripper at various angles relative to the tension setting mechanism, due to different elevations from the point where the string is clamped relative to where the string enters the string gripper, the line of action of the string force relative to the string gripper will change, and will effect the correlation between the desired string tension and the predetermined setting of the string tension on the string tensioner. In these situations, the braking mechanism will be activated too late or too soon resulting in more or less than the desired tension in the string. In this situation, the racquet stringing machine is said to be out of calibration and requires some adjustment.

The Longeat patent teaches the use of a circular shaped guiding device to guide the string from the racquet into the gripper of the string tensioner. However, the guiding device is permanently attached to the string gripper and tension setting mechanism, and effectively becomes part of the string gripper and tension setting mechanism. Therefore, the line of action of the string force from the racquet to the guiding device will change as the angle of the string entering the guiding device is changed. As mentioned previously, the change to the line of action of the string force on the tension setting mechanism effects the calibration of the racquet stringing machine.

While the prior art stringing devices can be adjusted, or calibrated, to compensate for the different lines of action in which the string force is applied to the string gripper and tension setting mechanism, this adjustment or calibration process, is tedious and inconvenient, and must be done prior to stringing every racquet.

Therefore, there exists a need to improve the current racquet stringing devices to overcome the stated disadvantages associated with how the string is guided to the string gripper and tension setting mechanism of the string tensioner.

SUMMARY OF THE INVENTION

The present invention provides a string tensioner having a string guide designed to satisfy the aforementioned need by maintaining a constant string line of action to the string gripper and tension setting mechanism of the string tensioner. As discussed above, the string tensioners of prior art racquet stringing machines need to be adjusted each time the angle in which the string tension is applied to the string gripper and the tension setting mechanism (such as a leverage system or force sensing system) changes, otherwise the amount of tension applied to the string will change. Since these prior art systems rely on a certain line of action of the string tension against the string gripper and tension setting mechanism, when the line of action of the string tension is changed the fixed correlation between the predetermined tension setting which achieves the desired string tension and the counter force leverage or force measured by the tension setting mechanism will be different, causing the string tensioner to halt the tensioning of the string at a tension which is greater than or less than the desired tension. By using the string guide of the present invention that is fixed, or preferably rotatably mounted to the string tensioner, and independent of the tension setting mechanism, the string can be guided to the string gripper and tension setting mechanism at a fixed relation such that the angle in which the string tension is applied to the string gripper and the tension setting mechanism will always remain the same. The string guide will therefore maintain the fixed correlation between the predetermined tension settings which achieve the desired string tensions and the tension setting mechanism and will not require constant adjustment of the tension settings each time the angle in which the string approaches the string gripper and tension setting mechanism is changed.

Accordingly, the present invention is directed to a string tensioning device for a sports racquet stringing machine having a string clamping device for clamping a sports racquet string to hold the string under tension within a sports racquet. The string tension device comprises: (a) string gripper means for gripping a string extending from the string clamping device of the sports racquet stringing machine to hold the string under tension; (b) string tension setting means associated with said string gripper means for causing the string to be pulled and stretched to achieve a desired tension in the string at a predetermined tension setting; and (c) a string guide supported independently of said string gripper means and disposed between said string clamping device and said string gripper means in defining a string clamping portion of said string extending between said clamping device and said string guide and a string gripper portion of said string extending between said string guide and said string gripper means, said string guide directing the string gripper portion of the string to said string gripper means at a constant string line of action as the string is pulled by said string tension setting means so as to produce a constant entry angle for said string gripper portion to said string gripper means and thereby provide substantially equal magnitudes of string tension in said string clamping portion and in said string gripper portion irrespective of a change of elevation of the string clamping device relative to said string gripper means.

The present invention is also directed to a machine for stringing sports racquets, comprising: (a) frame means for mounting a sports racquet; (b) a string clamping device on said frame means for clamping a sports racquet string to hold the string under tension within the sports racquet; (c) string gripper means mounted adjacent to said frame means and the sports racquet mounted thereon for gripping the string extending from said string clamping device to hold the string under tension; (d) string tension setting means associated with said string gripper means for causing the string to be pulled and stretched to achieve a desired tension in the string at a predetermined tension setting; (e) a siring guide disposed between said string clamping device and said string gripper means in defining a string clamping portion of said string extending between said clamping device and said string guide and a string gripper portion of said string extending between said string guide and said string gripper means, said string guide directing the string gripper portion of the string to said string gripper means at a constant string line of action as the string is pulled by said string tension setting means so as to produce a constant entry angle for said string gripper portion to said string gripper means and thereby provide substantially equal magnitudes of string tension in said string clamping portion and in said string gripper portion irrespective of a change of elevation of the string clamping device relative to said string gripper means; and (e) support means including a tensioner frame for mounting said string gripper means and said string tension setting means thereon and an arm attached to said tensioner frame for rotationally mounting said string guide such that said string guide is supported independently of said string gripper means.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following description, reference will be made to the attached drawings in which.

DETAILED DESCRIPTION OF THE INVENTION

Figure 1:
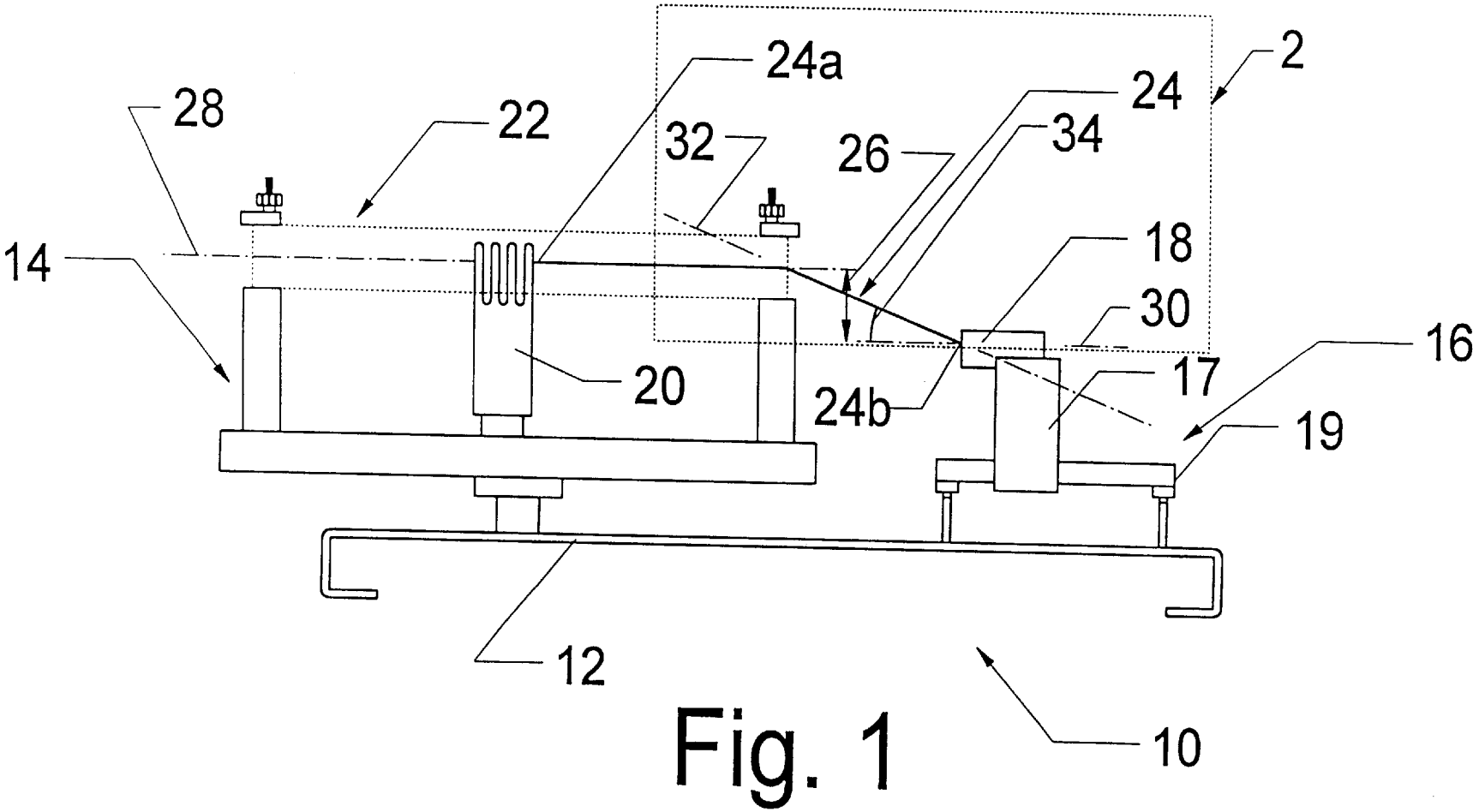
Fig. 1 (PRIOR ART)
FIG. 1 is an elevational view of a prior art stringing machine.

In the following description, like reference characters designate like or corresponding parts throughout the several views. Also, in the following description, it is understood that terms such as "forward", "rearward", "left", "right", "upwardly", "downwardly", and the like, are words of convenience and are not construed to be limiting terms.

Referring to the drawings and particularly to FIG. 1, there is illustrated a prior art stringing machine, being generally indicated by the numeral 10. The prior art stringing machine 10 includes a base 12, a racquet mounting frame, generally indicated by the numeral 14, attached to the base 12, and a string tensioner, generally indicated by the numeral 16, attached to the base 12 in an offset relationship to the racquet mounting frame 14. The string tensioner 16 includes a string gripper 18, a tension setting mechanism 17 and a string tensioner frame 19. The string gripper 18 is attached to the tension setting mechanism 17 which, in turn, is movably attached to the string tensioner frame 19. Tension may be applied to string 24 by moving the string tensioner 16 relative to base 12, in a manner similar to that described by Held. Tension may also be applied to string 24 by moving the string gripper 18 and tension setting mechanism 17 relative to the string tensioner frame 19 in a manner similar to that described by Longeat. These methods of applying tension to strings are well known by those skilled in the art and will not be described in detail here.

Also seen in FIG. 1 is a string clamping device 20 attached to the racquet mounting frame 14, a phantom image of the hoop of a racquet, generally indicated by the numeral 22, mounted to the racquet mounting frame 14, a string, generally indicated by the numeral 24, installed in the racquet 22 and having a clamped end 24*a* secured by the string clamping device 20 and held in fixed relation to the racquet frame 22, and a tensioning end 24*b* secured by the string gripper 18 while tension is applied by the string tensioner 16. The string 24 exits the racquet 22 at an elevation 26 relative to the string gripper 18 to define a string plane 28 relative to and parallel to a string gripper plane 30 such that a string line of action 32 is established between the location where the string 24 exits the racquet 22 and enters the string gripper 18, creating a string-to-gripper angle 34 between the string line of action 32 and the string gripper plane 30.

Figure 2:
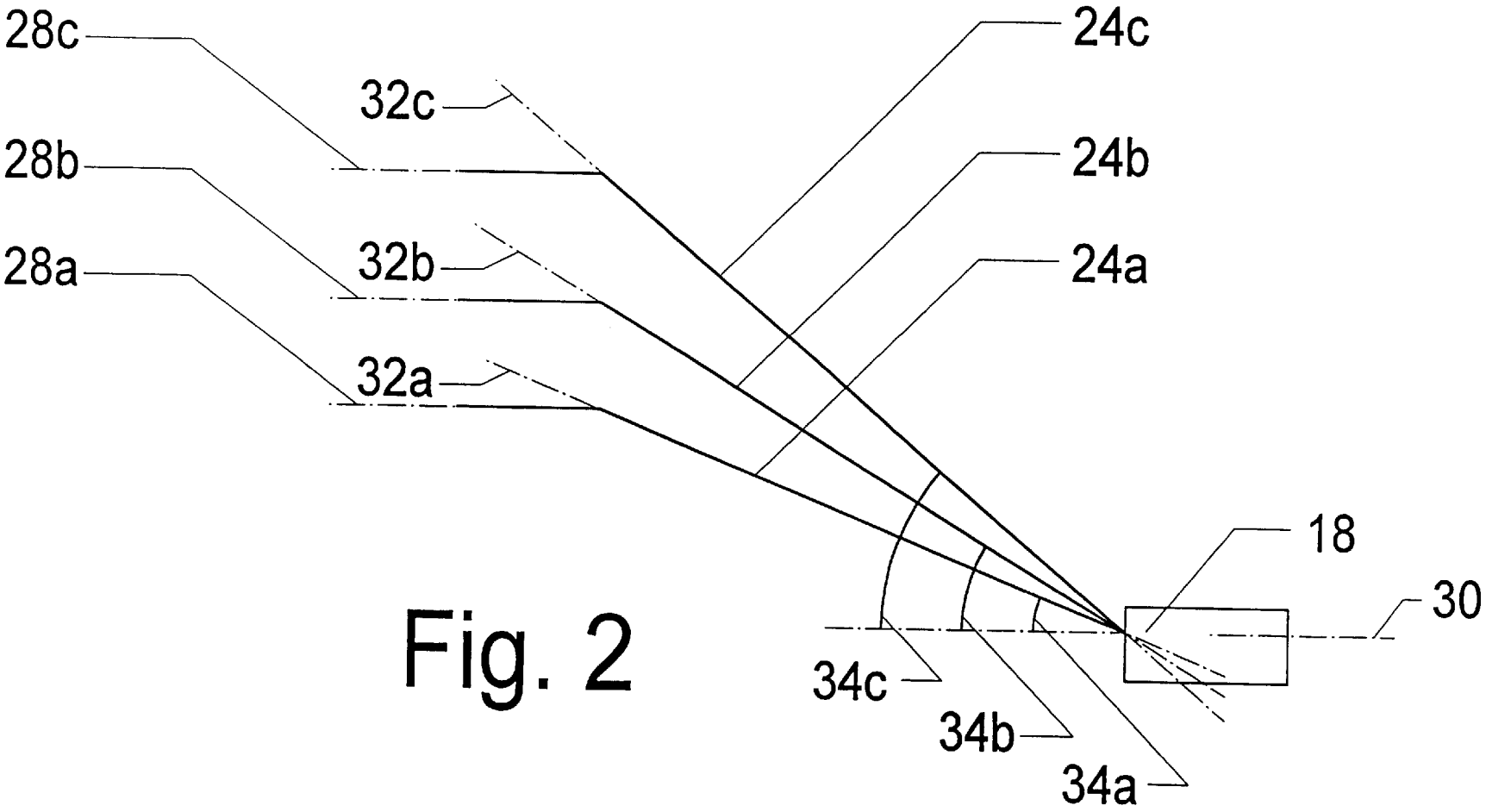
FIG. 2 is an enlarged view of a portion of the prior art stringing machine of FIG. 1, as enclosed by dotted rectangle 2, showing the path of the string as it exits the racquet frame, at various elevations relative to the string tensioner, and enters the string tensioner, at various angles.
Figure 2C:
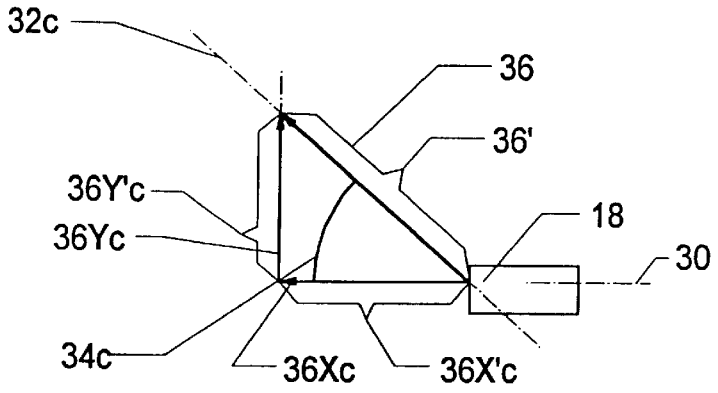
FIGS. 2*a*, 2*b*, and 2*c* are diagrammatic views representing the string tension forces exerted on the string gripper for strings tensioned at different elevations relative to the string gripper for prior art stringing machines.
Figure 2B:
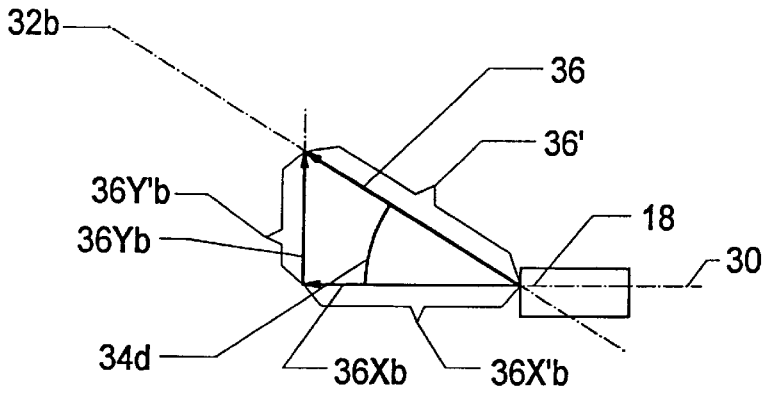
Figure 2A:
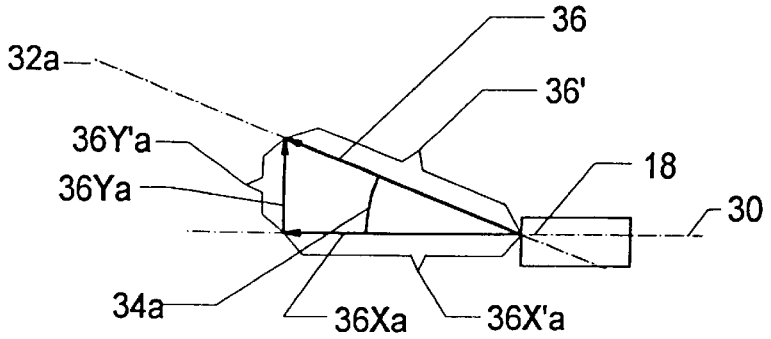

Referring to FIG. 2, there is represented various string lines of action 32*a*, 32*b*, and 32*c* for various respective strings 24*a*, 24*b*, and 24*c* having various respective string planes 28*a*, 28*b*, and 28*c* that produce various respective string-to-gripper angles 34*a*, 34*b*, and 34*c* relative to a single string gripper plane 30. More particularly, FIGS. 2*a*, 2*b*, and 2*c* respectively show diagrammatically a desired string tension 36 having a magnitude of 36' applied along the string lines of action 32*a*, 32*b*, and 32*c* of FIG. 2 to the string gripper 18, at their respective string-to-gripper angles 34*a*, 34*b*, and 34*c* of FIG. 2, for the prior art stringing machine 10 of FIG. 1. The component of force from the desired string tension 36 applied to the string gripper 18 in a direction perpendicular to the string gripper plane 30 is denoted in these figures by 36Y*a*, 36Y*b*, and 36Y*c* respectively, having a magnitude of 36Y'*a*, 36Y'*b*, and 36Y'*c* respectively, and the component force from the desired string tension 36 acting in a direction parallel to the string gripper plane 30 is denoted in these figures by 36X*a*, 36X*b*, and 36X*c* respectively, having a magnitude of 36X'*a*, 36X'*b* and 36X'*c* respectively.

Figure 3:
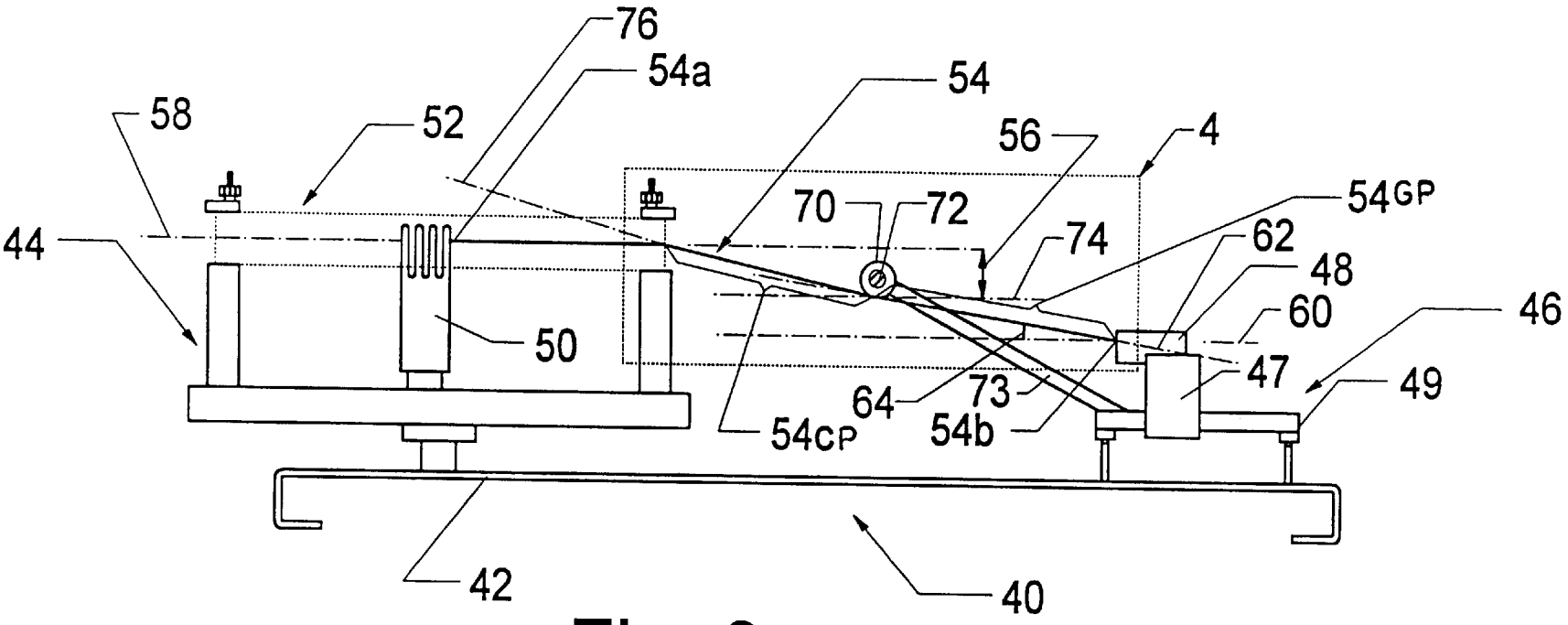
FIG. 3 is an elevational view of the improved stringing machine incorporating the rotatable string guide of the present invention.

Referring to FIG. 3, there is illustrated an improved stringing machine of the present invention, being generally indicated by the numeral 40. Like the prior art stringing machine 10, the improved stringing machine 40 includes a base 42, a racquet mounting frame, generally indicated by the numeral 44, attached to the base 42, and a string tensioner, generally indicated by the numeral 46, attached to the base 42 in an offset relationship to the racquet mounting frame 44. The string tensioner 46 which is movably attached to base 42 and includes a string gripper 48, a tension setting mechanism 47 and a string tensioner frame 49. The string gripper 48 is attached to the tension setting mechanism 47 which, in turn, is attached to the string tensioner frame 49. Also shown in FIG. 3 is a string clamping device 50 attached to the racquet mounting frame 44, a phantom image of a racquet hoop, generally indicated by the numeral 52, mounted to the racquet mounting frame 44, and a string, generally indicated by the numeral 54, installed in the racquet 52 and having a clamped end 54*a* secured by the string clamping device 50 and held in fixed relation to the racquet frame 52, and a tensioning end 54*b* secured by the string gripper 48 while tension is applied by the string tensioner 46.

In accordance with the present invention, the improved stringing machine 40 further includes a string guide 70 which is generally round in cross section. The string guide 70 is rotationally mounted on a pin 72 supported by an arm 73 attached to the string tensioner frame 49. Thus, in such manner, or any other suitable alterative manner, the string guide 70 is mounted in a fixed relation to the string gripper 48, and apart from the tension setting mechanism 47. The string 54 exits the racquet frame 52 at an elevation 56 relative to the string guide 70 to define a string plane 58 relative to and parallel to a string guide plane 74 to define a string guide line of action 76. The string 54 exits the string clamp 50, enters the string guide 70, exits the string guide 70, and enters the string gripper 48 such that a string line of action 62 is established between the point where the string makes contact with the string guide 70 and enters the string gripper 48 along a string gripper plane 60 which is parallel to the string guide plane 74, creating a string gripper angle 64 between the string line of action 62 and the string gripper plane 60. A string clamping portion 54*c* of string 54 is located on the string clamping device 50 side of the string guide 70 and a string tensioning portion 54*d* of string 54 is located to the string gripper 48 side of the string guide 70. Tension is applied to string 54 by moving the string tensioner 46 relative to the base 42, so as to stretch the string in a manner similar to that described by Held. This method of tensioning is well known to those skilled in the art and will not be described in detail here.

Figure 3A:
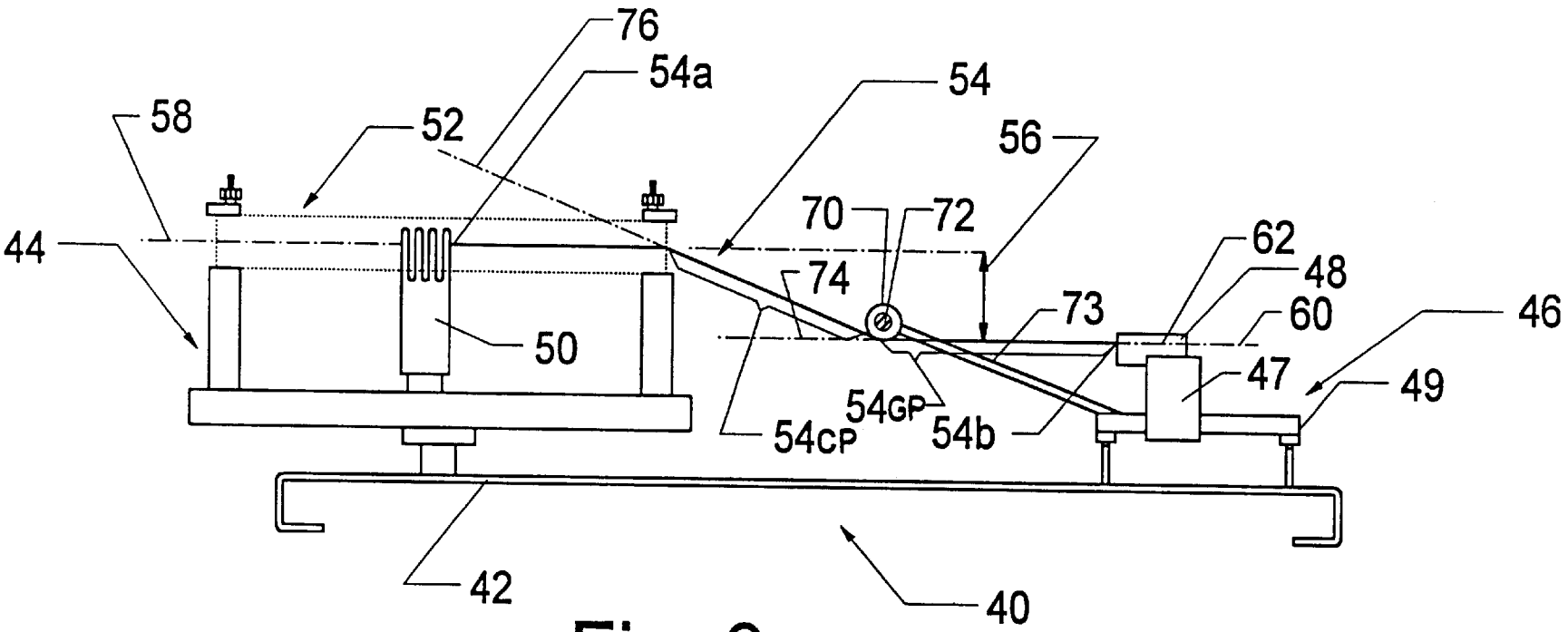
FIG. 3*a* is an elevational view of another embodiment of the improved stringing machine incorporating the rotatable string guide of the present invention.

Referring to FIG. 3*a*., there is illustrated another embodiment of the improved stringing machine, similar to that shown in FIG. 3, except that the elevation of the string guide 70 is set such that the string line of action 62, is on the same plane as the string guide plane 74, which is on the same plane as the string gripper plane 60. Thus the string gripper angle 64, illustrated in FIG. 3, is zero degrees and therefore not shown in FIG. 3*a*. In this embodiment, tension is applied to the string 54 by moving the string gripper 48 and tension setting mechanism 47 relative to the string tensioner frame 49. The string tensioner frame 49, is fixedly attached to the base 42. The string tension is applied to string 54 in this embodiment in a manner similar to that described by Longeat and is well known to those skilled in the art. It will therefore, not be described in detail here.

Figure 4:
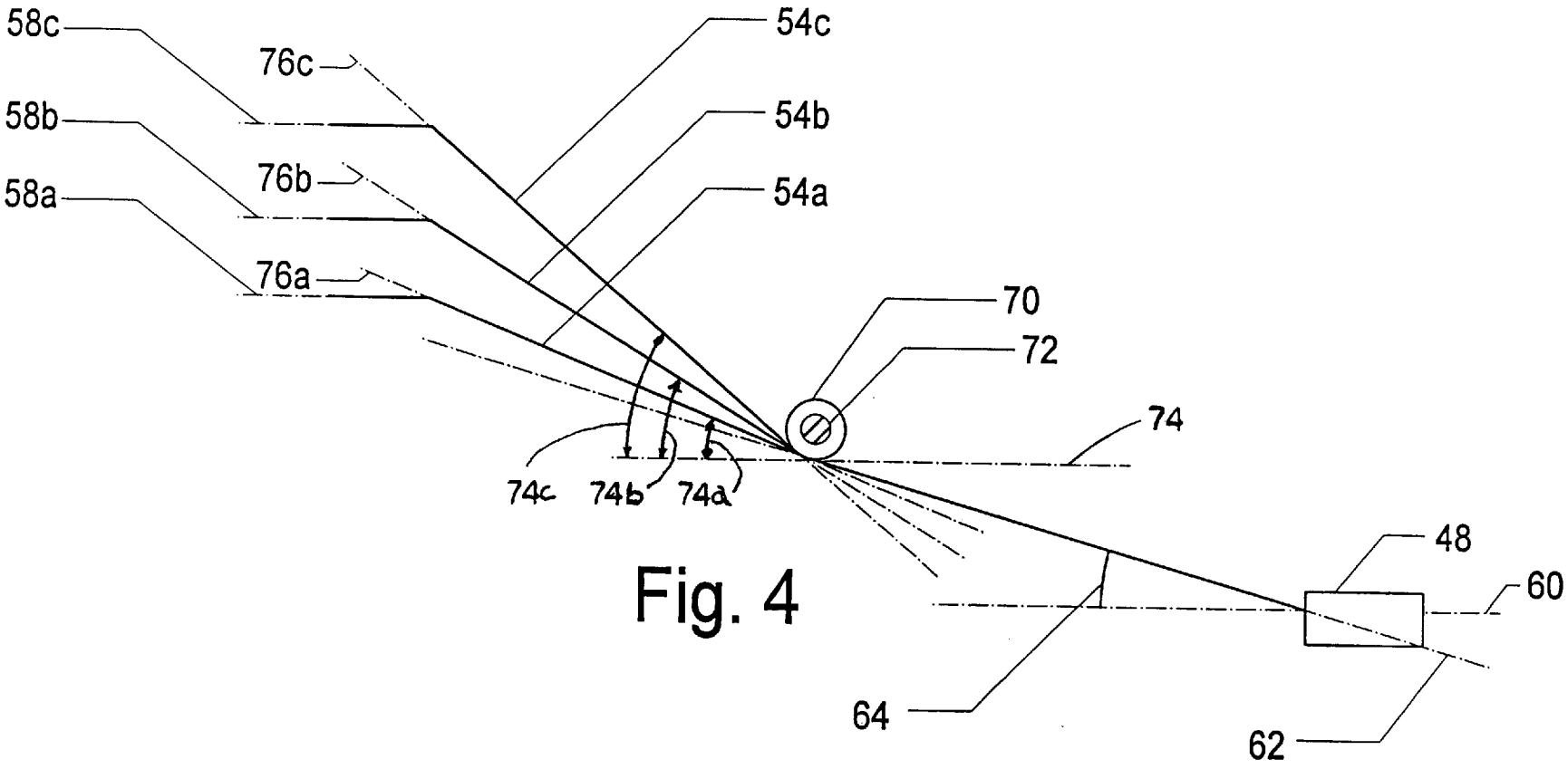
FIG. 4 is an enlarged view of a portion of the improved stringing machine of FIG. 3, as enclosed by dotted rectangle 4, showing the path of the string, in accordance with the present invention, as its exits the racquet frame, at various elevations relative to the string tensioner, and enters the string guide, at various angles before entering the string tensioner at a consistent angle on the improved stringing machine of FIG. 3.
Figure 4C:
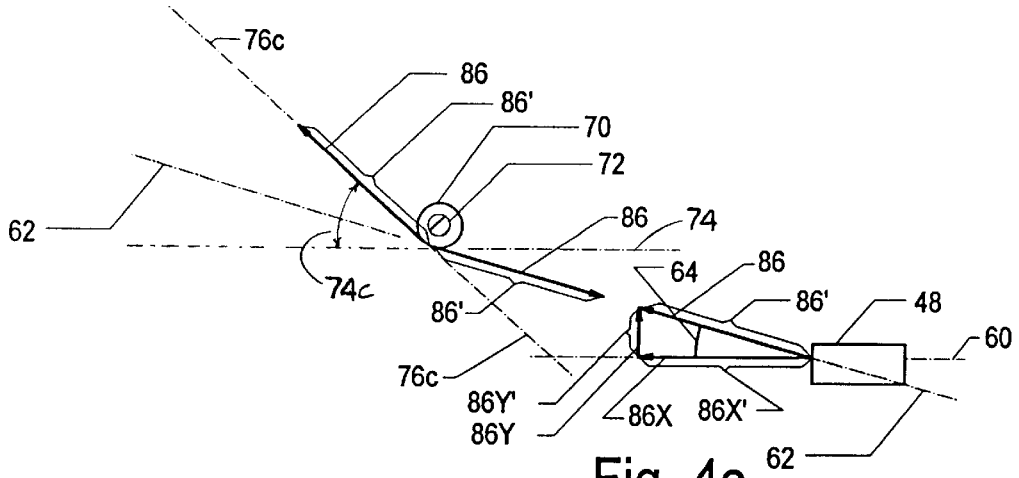
FIGS. 4*a*, 4*b*, and 4*c* are diagrammatic views, similar to FIGS. 2*a*–2*c*, but now showing the string tension forces exerted on the string guide and string gripper for strings tensioned at different elevations relative to the string gripper on the improved stringing machine of FIG. 3 that incorporates the string guide of the present invention.
Figure 4B:
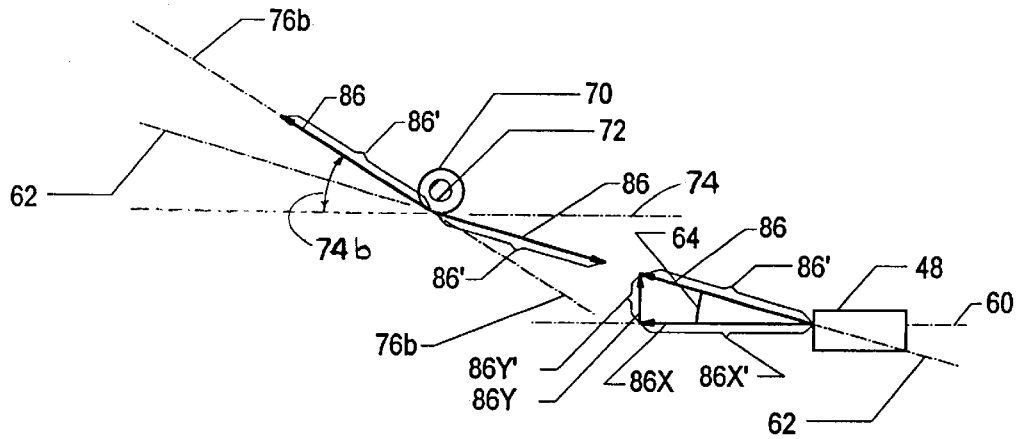
Figure 4A:
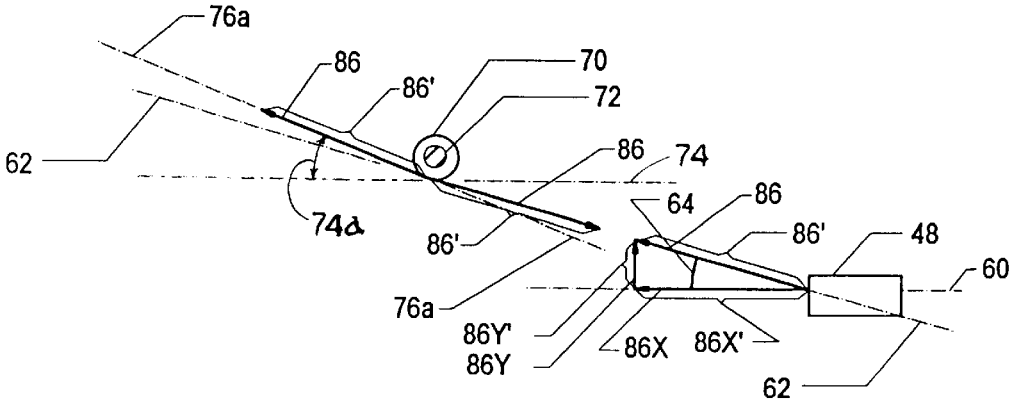

Referring to FIG. 4, which is an enlarged view of a portion of FIG. 3 enclosed by the dotted rectangle 4, there is represented various string guide lines of action 76*a*, 76*b*, and 76*c* for various respective strings 54*a*, 54*b*, and 54*c* having various respective string planes 58*a*, 58*b*, and 58*c* and corresponding string-to-guide angles 74*a*, 74*b* and 74*c* relative to the string guide plane 74 that produce a single string line of action 62 at a single string-to-gripper angle 64 relative to the string gripper 48 along the string gripper plane 60. More particularly, FIGS. 4*a*, 4*b*, and 4*c* respectively shown diagrammatically a desired string tension 86 having a magnitude of 86' applied along the string guide lines of action 76*a*, 76*b*, and 76*c* of FIG. 4 to the string guide 70, rotationally mounted to pin 72, and along string line of action 62 of FIG. 4 to the string gripper 48, at the string-to-gripper angle 64 of FIG. 4, for the improved stringing machine 40 of FIG. 3. The component of force from the desired string tension 86 applied to the string gripper 48 in a direction perpendicular to the string gripper plane 60 is denoted in FIGS. 4*a*, 4*b*, and 4*c* by 86Y, having a magnitude of 86Y', and the component force from the desired string tension 86 acting in a direction parallel to the string gripper plane 60 is denoted in FIGS. 4*a*, 4*b*, and 4*c* by 86X, having a magnitude of 86X'.

The present invention provides an improvement of the prior art stringing machine illustrated in FIG. 1. In prior art stringing machines such as the one illustrated in FIG. 1, the stringing machine tension setting mechanism 17 is typically designed in such a way that when predetermined magnitudes of string tension 36' are applied to string gripper 18, the magnitude of the component of string tension 36 in the direction parallel to the string gripper plane 30, denoted previously as 36X' *a, b*, and *c* (hereinafter referred to as 36X' for the purpose of this description) will cause string tensioner 16 to stop pulling the string 24. The intention is that a means to stop pulling the string 24 (typical means described in the prior art referenced previously) is designed into the tension setting mechanism 17 wherein there exists a fixed relation between the magnitude of the component of string tension in a direction parallel to the string gripper plane 36X' and the means to stop pulling the string when the desired tension is reached, for a range of desired string tensions 36.

A deficiency in the prior art stringing machine 10 arises when the elevation 26 of the string plane 28 relative to the string gripper plane 30 is changed. The change in elevation 26 causes a change in the magnitude of the component of string tension in a direction parallel to the string gripper plane 36X', for the same desired string tension 36. This occurs since the magnitude of the component of string tension in a direction parallel to the string gripper plane 36X' is equal to the magnitude of string tension 36' multiplied by the value of the cosine of the string to-gripper angle 34. It is obvious from FIGS. 1, 2, 2*a*, 2*b*, and 2*c*, that as the elevation 26 of the string plane 28 relative to the string gripper plane 30 changes, the string-to-gripper angle 34 changes, which changes the magnitude of the component of string tension in a direction parallel to the string gripper plane 36X'. This in turn changes the fixed relation between the magnitude of the component of string tension in a direction parallel to the string gripper plane 36X' and the means to stop pulling the string. Therefore, the tension setting mechanism 17 of the prior art stringing machine 10 must be constantly adjusted when the string-to-gripper angle 34 changes which is time consuming and inconvenient.

The improvement and object of the present invention as illustrated in FIG. 3 and FIG. 3*a*,involve the addition of the string guide 70, preferably rotationally mounted, as described above, in a fixed relation to the string gripper 48 of the improved stringing machine 40, and independent of the string gripper 48 and tension setting mechanism 47. The string guide 70 will receive the string 54 being installed in racquet hoop 52 and direct it to the string gripper 48 along the same string line of action 62, to produce the same string-to-gripper angle 64, regardless of the elevation 56 of the string plane 58 relative to the string guide 70. By being rotationally mounted to pin 72, the string guide 70 acts as a pulley such that the magnitude of string tension 86' is the same on the string clamp portion 54*cp* of string 54 as it is on the string gripper portion 54*gp* of string 54. By being mounted in a fixed relation to the string gripper 48, the string line of action 62 will remain constant and the string gripper portion 54*gp* will enter the string gripper 48 at a constant string-to-gripper angle 64 irrespective of the string-to-guide angle 74*a*, 74*b* or 74*c* of the string clamp portion 54*cp* of string 54 relative to the string guide 70 along the string guide plane 74.

As described previously, but now applied to the improved stringing machine 40, the stringing machine tension setting mechanism 47 is typically designed in such a way that when predetermined magnitudes of string tension 86' are applied to string gripper 48, the magnitude of the component of string tension 86 in the direction parallel to the string gripper plane 60, 86X' will cause string tensioner 46 to stop pulling string 54. A means to stop pulling string 54 (again with typical means described in the prior art referenced previously) is designed into the tension setting mechanism 47 wherein there exists tension settings based on a fixed relation between the magnitude of the component of string tension in a direction parallel to the string gripper plane 86X' and the means to stop pulling the string when the desired tension is reached, for a range of desired string tensions 86.

The magnitude of the component of string tension in a direction parallel to the string gripper plane 86X' is equal to the magnitude of string tension 86' multiplied by the value of the cosine of the string to gripper angle 64. It is obvious from FIGS. 3, 4, 4*a*, 4*b*, and 4*c*, that as the elevation 56 of the string plane 58 relative to the string guide plane 74 changes, the string-to-gripper angle 64 remains constant, which keeps the magnitude of the component of string tension in a direction parallel to the string gripper plane 86X' constant. Therefore, the tension settings based on the fixed relation between the magnitude of the component of string tension in a direction parallel to the string gripper plane 86X' and the means to stop pulling the string will remain applicable regardless of the elevation of the string plane 58 relative to the string gripper 48, and not require the tedious and inconvenient task of readjusting the tension setting mechanism 47 each time the elevation of string plane 58 changes.

It is understood that the present invention and many of its attendant advantages will be understood from the foregoing description and it will be apparent that various changes may be made in the form of the invention without departing from the spirit and scope of the invention or sacrificing all of its material advantages, the form herein before described being merely an example or exemplary embodiment thereof.

I claim:

1. A string tensioning device for a stringing machine used for stringing a sports racquet adapted to be strung with a plurality of strings defining a stringing plane, said stringing machine having a string clamping device for clamping one of said plurality of strings and holding said one string under tension within said sports racquet, said string tensioning device comprising:

(a) string gripper means defining a string gripper plane spaced from said stringing plane and for gripping said one string extending from the string clamping device of said stringing machine and holding said one string under tension;

(b) string tension setting means associated with said string gripper means for causing said one string to be pulled and stretched to achieve a desired tension in said one string at a predetermined tension setting; and (c) a string guide defining a string guide plane spaced from said stringing plane and supported independently of said string gripper means and being disposed between said string clamping device and said string gripper means so as to divide said one string into a string clamping portion extending between said string clamping device and said string guide and forming a string-to-guide angle relative to said string guide plane and a string gripper portion extending between said string guide and said string gripper means and forming a string-to-gripper angle relative to said string gripper plane such that said string-to-gripper angle of said string gripper portion is held constant irrespective of a change in said string-to-guide angle of said string clamping portion during tensioning of said one string by said tension setting means.

2. The device as recited in claim 1, wherein:

said string gripper means and said string tension setting means are movable relative to said string guide; and said string guide is disposed at an elevation to said string gripper means so as to produce a constant string-to-gripper angle for said string gripper portion of said string.

3. The device as recited in claim 1, wherein:

said string guide, said string gripper means and said string tension setting means are movable relative to said string clamping device; and said string guide is preset at any elevation relative to said string gripper means so as to produce a constant string-to-gripper angle for said string gripper portion of said string.

4. The device as recited in claim 1, wherein said string guide is rotationally mounted.

5. The device as recited in claim 4, wherein said string guide further includes an arm supporting said rotationally mounted string guide in an offset relation to said string gripper means.

6. The device as recited in claim 5, wherein said string tension setting means includes:

a string tensioner frame, said arm mounted on said string tensioner frame; and a tension setting mechanism mounted on said string tensioner frame.

7. The device as recited in claim 6, wherein:

said string gripper means is attached to said tension setting mechanism; and said tension setting mechanism together with said string gripper means are movable along said string tensioner frame toward and away from said string guide.

8. The device as recited in claim 6, wherein:

said string gripper means is attached to said string setting mechanism; and said string gripper means, said tension setting mechanism and said string guide are mounted to said string tensioner frame and movable together toward and away from said string clamping device.

9. The device as recited in claim 1, wherein said string guide is circular in cross section.

10. A machine for stringing sports racquets, comprising:

(a) frame means for mounting a sports racquet adapted to be strung with a plurality of strings defining a stringing plane;

(b) a string clamping device on said frame means for clamping a sports racquet string and holding the string under tension within the sports racquet;

(c) string gripper means defining a string gripper plane spaced from said stringing plane and mounted adjacent to said frame means and the sports racquet mounted thereon for gripping the string extending from said string clamping device and holding the string under tension;

(d) string tension setting means associated with said string gripper means for causing the string to be pulled and stretched to achieve a desired tension in the string at a predetermined tension setting;

(e) a string guide defining a string guide plane spaced from said stringing plane and disposed between said string clamping device and said string gripper means so as to divide said string into a string clamping portion extending between said clamping device and said string guide and forming a string-to-guide angle relative to said string guide plane and a string gripper portion extending between said string guide and said string gripper means and forming a string-to-gripper angle relative to said string gripper plane such that said string-to-gripper angle of said string gripper portion is held constant irrespective of a change in said string-to-guide angle of said string clamping portion during tensioning of said string by said tension setting means; and (e) support means including a tensioner frame for mounting said string gripper means and said string tension setting means thereon and an arm attached to said tensioner frame for mounting said string guide such that said string guide is supported independently of said string gripper means.

11. The machine as recited in claim 10, wherein:

said string gripper means and said string tension setting means are movable mounted on said tensioner frame such that said string gripper means and said string tension setting means can be moved along said tensioner frame relative to said string guide for tensioning of the string during the string tensioning process; and said arm is fixed to said tensioner frame such that said string guide is disposed at an elevation to said string gripper means so as to produce a constant string-to-to-gripper angle for said string gripper portion of said string.

12. The machine as recited in claim 10, wherein:

said tensioner frame having said string guide, said string gripper means and said string tension setting means mounted thereon is movable relative to said string clamping device to tension said string during the string tensioning process; and said arm is fixed to said tensioner frame to position said string guide at any elevation relative to said string gripper means so as to produce a constant string-to-gripper angle for said string gripper portion of said string.

13. The machine as recited in claim 10, wherein said string guide is circular in cross section and rotationally mounted on said arm.

14. A string tensioning device for a stringing machine used for stringing a sports racquet adapted to be strung with a plurality of strings defining a stringing plane, said stringing machine having a string clamping device for clamping a sports racquet string and holding the string under tension within the sports racquet, said string tensioning device comprising:

(a) string gripper means defining a string gripper plane spaced from said stringing plane and for gripping a string extending from the string clamping device of the stringing machine and holding the string under tension;

(b) string tension setting means associated with said string gripper means for causing the string to be pulled and stretched to achieve a desired tension in the string at a predetermined tension setting;

(c) a string guide defining a string guide plane spaced from said stringing plane and disposed between said string clamping device and said string gripper means so as to divide said string into a string clamping portion extending between said clamping device and said string guide and forming a string-to-guide angle relative to said string guide plane and a string gripper portion extending between said string guide and said string gripper a string-to-gripper angle relative to said string gripper plane such that said string-to-gripper angle of said string gripper portion is held constant as said string is pulled and stretched by said string tension setting means; and (d) support means for supporting said string guide independently of said string gripper means and said string tension setting means such that the forces applied to said string guide and said string guide support means by the tension in the string do not influence the ability of said string tension setting means to achieve the desired tension at the predetermined tension setting irrespective of a change in said string-to-guide angle of said string clamping portion of said string.

15. The device as recited in claim 14, wherein:

said string gripper means and said string tension setting means are movable relative to said string guide; and said string guide is disposed at an elevation to said string gripper means so as to produce a constant string-to-gripper angle for said string gripper portion of said string.

16. The device as recited in claim 14, wherein:

said string guide, said string gripper means and said string tension setting means are movable relative to said string clamping device; and said string guide is preset at any elevation relative to said string gripper means so as to produce a constant string-to-gripper angle for said string gripper portion of said string.

17. The device as recited in claim 14, wherein said string guide is rotationally mounted.

18. The device as recited in claim 17, wherein:

said string guide further includes an arm supporting said rotationally mounted string guide in an offset relation to said string gripper means; and said string tension setting means includes:

a string tensioner frame, said arm mounted on said string tensioner frame, and a tension setting mechanism mounted on said string tensioner frame.

19. The device as recited in claim 18, wherein:

said string gripper means is attached to said tension setting mechanism; and said tension setting mechanism together with said string gripper means are movable along said string tensioner frame toward and away from said string guide.

20. The device as recited in claim 18, wherein:

said string gripper means is attached to said string setting mechanism; and said string gripper means, said tension setting mechanism and said string guide are mounted to said string tensioner frame and movable together toward and away from said string clamping device.

* * * * *